US005974992A

United States Patent [19]

Asano

[11] Patent Number: 5,974,992

[45] Date of Patent: Nov. 2, 1999

[54] PRODUCTION MANAGEMENT SYSTEM FOR MANAGING SEWING OPERATIONS OF A PLURALITY OF EMBROIDERY SEWING MACHINES

[75] Inventor: Fumiaki Asano, Nagoya, Japan

[73] Assignee: Brother Kogyo Kabushiki Kaisha, Aichi-ken, Japan

[21] Appl. No.: 09/267,168

[22] Filed: Mar. 12, 1999

[30] Foreign Application Priority Data

Mar. 13, 1998 [JP] Japan ..... 10-082515

[51] Int. Cl.[6] ..... D05B 21/00; D05B 25/00; D05C 5/06

[52] U.S. Cl. ..... 112/102.5; 112/155; 364/470.09

[58] Field of Search ..... 112/102.5, 470.06, 112/155, 445, 454, 456, 458, 470.02, 475.19; 364/470.09, 470.07

[56] References Cited

U.S. PATENT DOCUMENTS 5,050,513 9/1991 Frankel ..... 112/470.02
5,313,896 5/1994 Hashiride ..... 112/155 X
5,727,485 3/1998 Morita ..... 112/102.5
5,740,748 4/1998 Morita ..... 112/102.5
5,881,657 3/1999 Asano ..... 112/102.5

FOREIGN PATENT DOCUMENTS 7-194880 8/1995 Japan .

*Primary Examiner*—Peter Nerbun
*Attorney, Agent, or Firm*—Kane, Dalsimer, Sullivan, Kurucz, Levy, Eisele and Richard, LLP

[57] ABSTRACT

A lot sewing time required for sewing a lot of embroidery patterns is calculated based on data of the embroidery pattern to be sewn and on data indicating the number of times the embroidery pattern is to be sewn in the lot. After data for the calculated lot sewing time is received, the lot is allotted to one of a plurality of sewing machines. The lot time for each of a plurality of lots allotted to the plurality of sewing machines is displayed on a display.

17 Claims, 17 Drawing Sheets

M1～M4 : MULTI-HEAD EMBROIDERY SEWING MACHINE

| STITCH LENGTH (mm) / RANGE | 0 ~ 7.0 | 7.1 ~ 10.0 | 10.1 ~ 12.7 |
|---|---|---|---|
| 1 | d spm | e spm | g spm |
| 2 | e spm | f spm | g spm |
| 3 | g spm | g spm | g spm |

(d > e > f > g)

PRODUCTION MANAGEMENT SYSTEM FOR MANAGING SEWING OPERATIONS OF A PLURALITY OF EMBROIDERY SEWING MACHINES

BACKGROUND OF THE INVENTION

1. Field of the Invention

The present invention relates to a production system for managing sewing operations of a plurality of embroidery sewing machines.

2. Description of the Related Art

Japanese Patent-Application Publication (Kokai) No. HEI-7-194880 describes a sewing machine system including a personal computer connected to a plurality of embroidery sewing machines. The personal computer is used to monitor the present production situation of each sewing machine. The personal computer receives information about production performed by each of the plurality of embroidery sewing machines and displays the information in tables on a display. The information is updated in real time. Information displayed by the personal computer for each sewing machine includes the total running time up to present, the time consumed while switching embroidery frames, and the time consumed to correct thread breakage. This enables a manager to better grasp the present production situation.

Also, this Japanese publication describes using a bar graph to indicate percentage of each order each sewing machine has completed. This enables the manager to better grasp how production is progressing.

The system can also be used to accurately plan future production. For example, when an order is received, the personal computer refers to how operations for the subject embroidery pattern progressed in the past to predict how many sewing machines would have to be operated for how many hours to complete the order. Then the personal computer distributes the work out to the sewing machines in the system taking the present work situation into consideration.

SUMMARY OF THE INVENTION

However, Japanese Patent-Application Publication (Kokai) No. HEI-7-194880 is silent on details of how to predict future work. It is also silent on a configuration that allows the manager to access the information on future work.

It is an objective of the present invention to provide a production system for embroidery sewing machines that enables the user to simply and accurately determine lot times required to sew each single lot for each group of embroidery patterns, that enables the user to easily grasp the overall future production schedule, and that includes configuration for updating the production schedule based on current production conditions.

In order to achieve the above-described objectives, a system according to the present invention, which is for managing production of embroidery patterns embroidered by a plurality of sewing machines connected to the system, includes a display unit; an allotment unit, a lot time calculator, and a display control unit.

The allotment unit allots lots of embroidery patterns to the plurality of sewing machines.

The lot time calculator calculates a set of lot time data indicating estimated time required to sew an embroidery pattern in a plurality of times to produce a single lot of the embroidery pattern. The lot time calculator calculates the set of lot time data based on embroidery pattern data of the embroidery pattern and on repetition data indicating the plurality of times the embroidery pattern must be sewn to produce the single lot. The lot time calculator calculates a plurality of sets of lot time data, each set corresponding to one of the lots allotted to the sewing machines by the allotment unit.

The display control unit controls the display unit to display lot times of all lots allotted to the sewing machines by the allotment unit, based on the sets of lot time data.

According to another aspect of the present invention, a system includes a lot time calculator that calculates a set of lot time data indicating estimated time required to sew an embroidery pattern in a plurality of times to produce a single lot of the embroidery pattern; an allotment unit that allots the single lot to one of the plurality of sewing machines; and a display control unit that controls the display unit to display the lot time of the lot allotted to the one of the plurality of sewing machines.

A memory medium according to the present invention stores a program for managing production of embroidery patterns embroidered by a plurality of sewing machines. The program includes an allotment program, a lot time calculation program, and a display control program.

The allotment program allots lots of embroidery patterns to the plurality of sewing machines.

The lot time calculation program calculates a set of lot time data indicating estimated time required to sew an embroidery pattern in a plurality of times to produce a single lot of the embroidery pattern. The lot time calculation program calculates the set of lot time data based on embroidery pattern data of the embroidery pattern and on repetition data, which indicates the plurality of times the embroidery pattern must be sewn to produce the single lot. The lot time calculation program calculates a plurality of sets of lot time data, each set corresponding to one of the lots allotted to the sewing machines during the allotment program.

The display control program controls a display unit to display lot times of all lots allotted to the sewing machines during the allotment program, based on the sets of lot time data.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE EMBODIMENT

Figure 1:
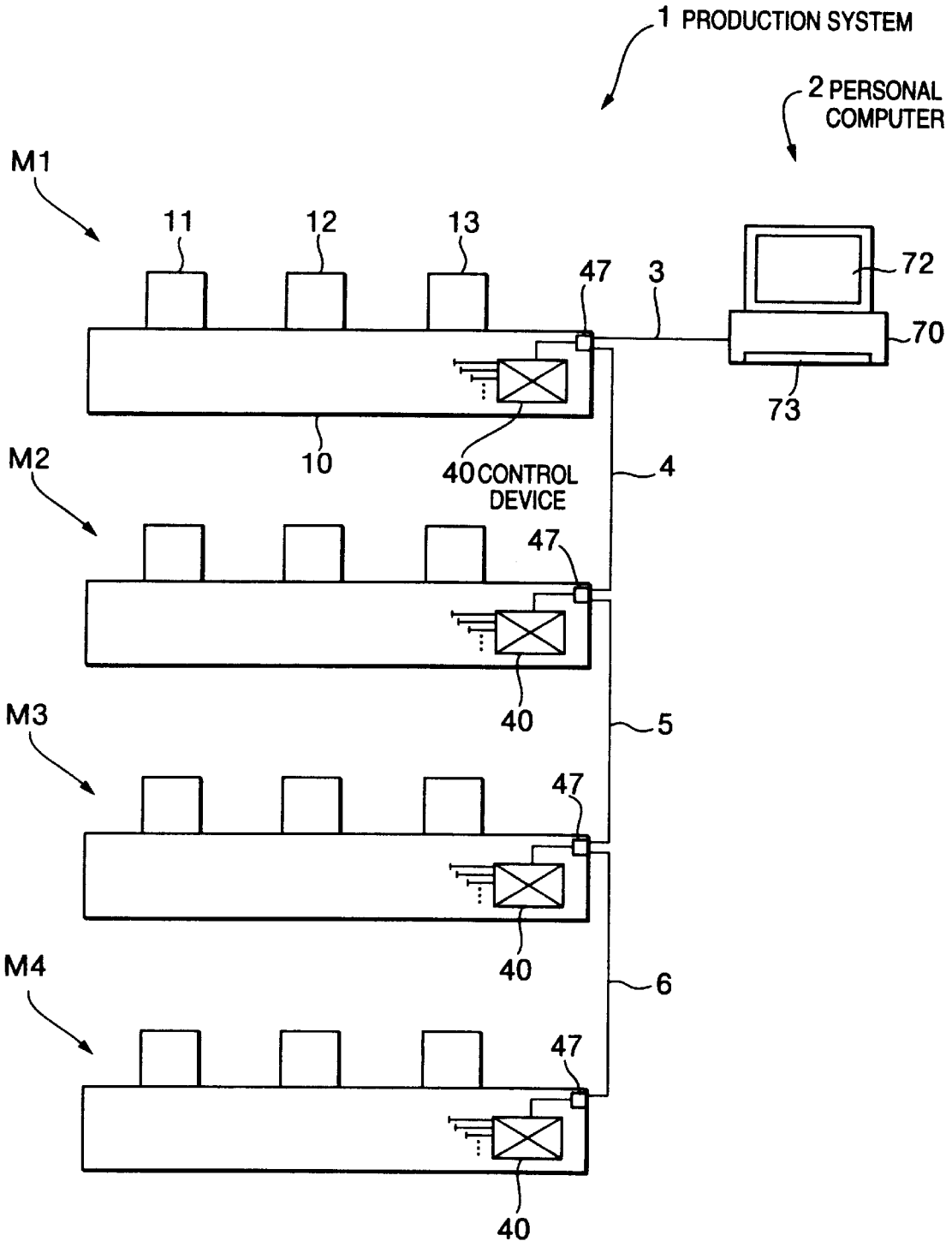
FIG. 1 is a plan view showing a production system according an embodiment of the present invention.

A production system according to an embodiment of the present invention will be described while referring to the accompanying drawings wherein like parts and components are designated by the same reference numerals to avoid duplicating description.

The present embodiment describes the present invention applied to a production system shown in FIG. 1 for managing sewing operations of a plurality of embroidery sewing machines.

The production system 1 shown in FIG. 1 includes a personal computer 2, four multi-head embroidery sewing machines M1 to M4, and transmission cables 3 to 6 for connecting the personal computer 2 in parallel with the multi-head embroidery sewing machines M1 to M4 in a bus-type configuration.

First, an explanation will be provided for the multi-head embroidery sewing machines M1 to M4. All of the multi-head embroidery sewing machines M1 to M4 have exactly the same configuration, so the following explanation will be provided for the multi-head embroidery sewing machine M1 as a representative example.

Figure 2:
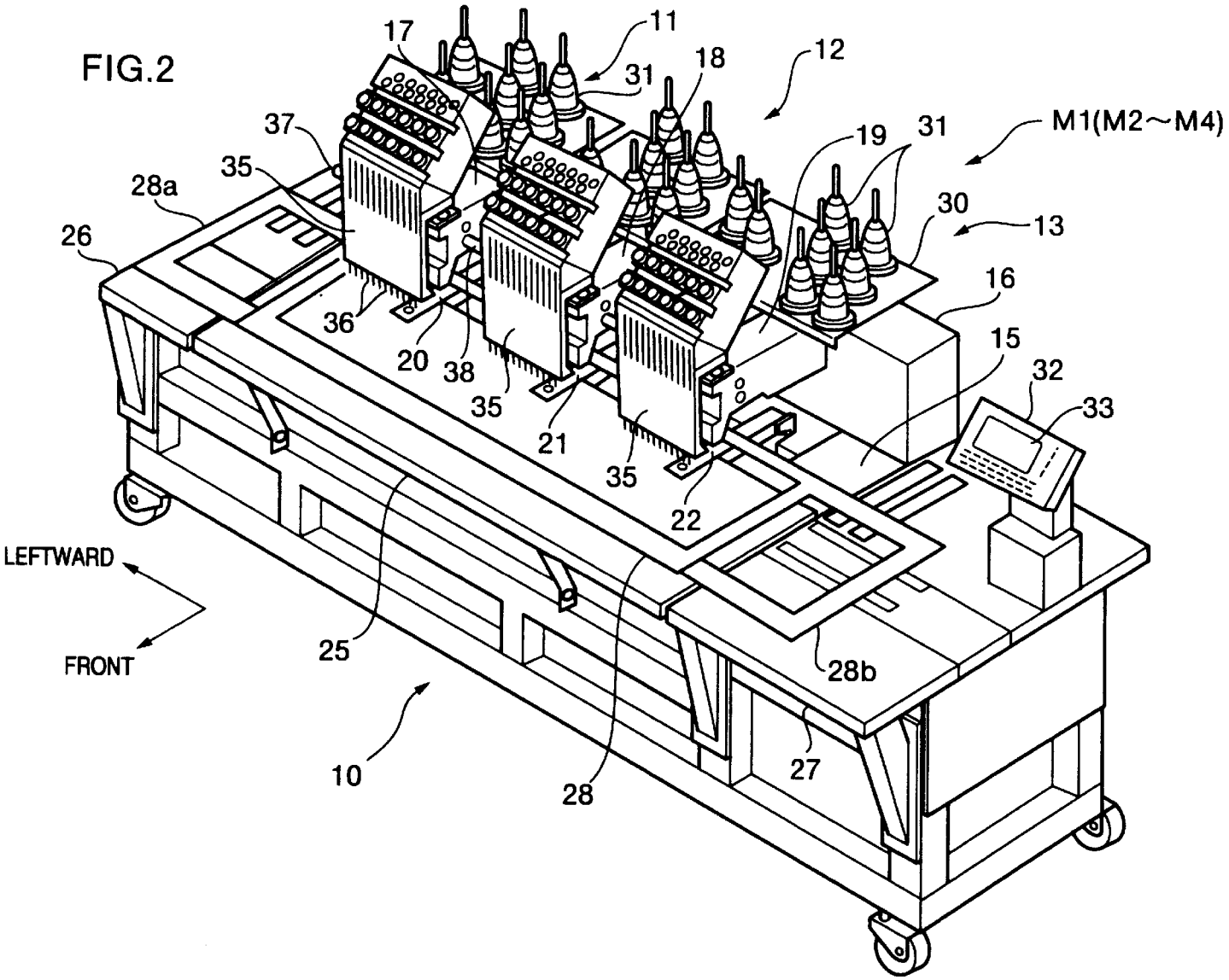
FIG. 2 is a perspective view showing an embroidery sewing machine of the system shown in FIG. 1.

As best seen in FIG. 2, the multi-head embroidery sewing machine M1 has a base frame 10 elongated in the rightward and leftward directions and three multi-needle sewing machines 11 to 13 aligned on the top of the base frame 10. An embroidery frame 28 for supporting a workpiece cloth is disposed between the base frame 10 and the sewing machines 10 to 13. Although not shown in the drawings, a front-rear drive mechanism is provided for driving movement of the embroidery frame 28 in front and rear directions. Also a left-right drive mechanism is provided for driving the embroidery frame 28 in leftward and rightward directions. With this configuration, the multi-needle sewing machines 11 to 13 operate in cooperation with the front-rear drive mechanism and the left-right drive mechanism to simultaneously sew the same embroidery pattern in the workpiece cloth supported in the embroidery frame 28.

A sewing machine support plate 15 having a substantially rectangular shape when viewed from above is provided at the rear portion of the base frame 10. A support frame 16 extending leftward and rightward with an upright posture is provided on the upper rear surface of the sewing machine support plate 15. The multi-needle sewing machines 11 to 13 include arm portions 17 to 19, respectively and corresponding bed portions 20 to 22, respectively. The arm portions 17 to 19 extend forward from the support frame 16 in confrontation with the bed portions 20 to 22, which extend forward from the base frame 10 from a position in front of the support frame 16.

A work table 25 is provided at the upper front side of the base frame 10. The work table 25 is supported at substantially the same level as the upper surfaces of bed portions 20 to 22. A pair of supplementary tables 26, 27 are positioned at the right and left sides respectively of the work table 25. The embroidery frame 28 is detachably provided on the tables 25 to 27. The embroidery frame 28 has a rectangular shape when viewed from above and is elongated in the leftward and rightward directions. The embroidery frame 28 is capable of supporting a workpiece cloth in a taught condition. The workpiece cloth is where the embroidery patterns are to be sewn.

A left and right drive frame portions 28*a*, 28*b* are provided on left and right sides, respectively, of the embroidery frame 28. While the embroidery frame 28 is in a mounted condition on the tables 25 to 27, the left drive frame portion 28*a* can drive front and rear movement of the embroidery frame 28 and the right drive frame portion 28*b* can drive left and right movement of the embroidery frame 28. The left drive frame portion 28*a* is driven by a front-rear drive mechanism, which includes a front-rear drive motor 61 shown in FIG. 3, and the right drive frame portion 28*b* is driven by the front-rear drive mechanism and also by a left-right drive mechanism, which includes a left-right drive motor 62 shown in FIG. 3.

Figure 3:
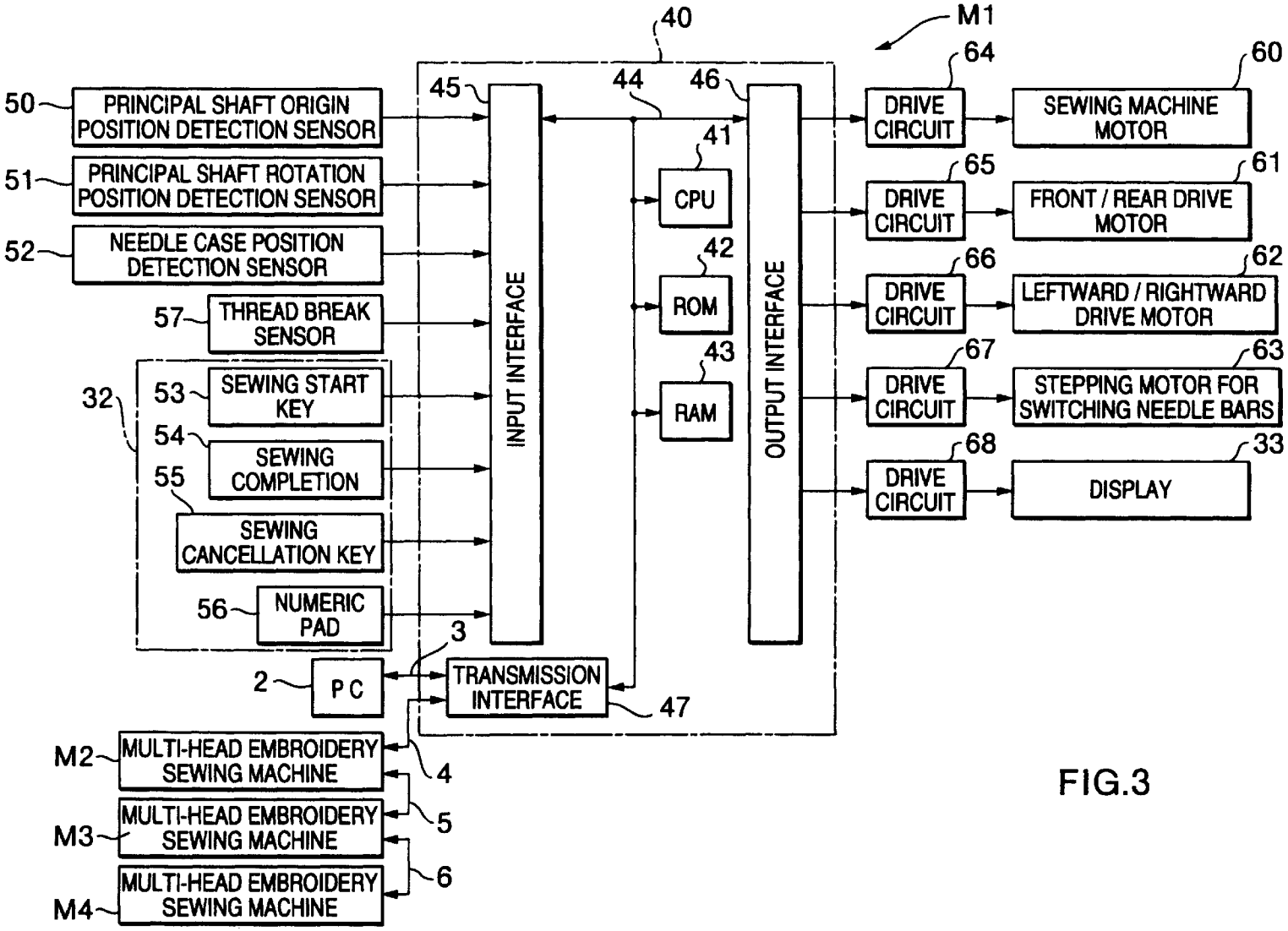
FIG. 3 is a block diagram representing electrical configuration of the embroidery sewing machine shown in FIG. 2.

Three thread stands 30 are provided on the upper surface of the support frame 16, each at a position corresponding to one of the multi-needle sewing machines 11 to 13. Each of the thread stands 30 has configuration for supporting twelve separate thread spools 31 in an upright orientation. An operation panel 32 is provided to the rear portion of the supplementary table 27. The operation panel 32 includes a liquid crystal display 33 for displaying information relating to embroidery patterns, and as shown in FIG. 3, a sewing start key 53, a sewing completion key 54, a sewing cancellation key 55, and a numeric pad 56.

Next, an explanation will be provided for the multi-needle sewing machines 11 to 13. All three of the multi-needle sewing machines 11 to 13 have exactly the same configuration. Therefore, the following explanation will be provided for only the multi-needle sewing machine 11 as a representative example.

The multi-needle sewing machine 11 includes a needle bar case 35, twelve needle bars 36, and twelve thread take-up levers 37. The twelve needle bars 36 are disposed in the needle bar case 35 with a vertical orientation and arranged in a single line extending leftward and rightward. The thread take-up levers 37 are disposed above the needle bars 36 so as to protrude from the needle bar case 35 in a single row that extends leftward and rightward.

Although not shown in the drawings, a variety of components are housed in the needle bar case 35, such as a needle bar drive mechanism for driving vertical movement of the particular needle bar 36 disposed at a sewing position above the bed portion 20; a thread take-up lever drive mechanism for driving vertical movement of the thread take-up lever 37 corresponding to the needle bar 36 at the sewing position; a needle bar switching mechanism for selectively moving the twelve needle bars 36 into the sewing position by moving the needle bar case 35 leftward and rightward; and a rotatable loop taker drive mechanism for driving a rotation type loop taker, which is for catching a thread loop of a sewing needle attached to the vertically moving needle bar 36.

A sewing machine motor 60 shown in FIG. 3 drives rotation of a principal shaft (not shown). The needle bar drive mechanism, the thread take-up lever drive mechanism, and the loop taker drive mechanism are driven in an interlocking manner with the principal shaft. The needle bar drive mechanism and the thread take-up lever drive mechanism vertically drive the needle bar 36 and the thread take-up lever 37 that are in the sewing position. The loop taker drive mechanism drives rotation of the rotation type loop taker in association with the principal shaft.

Although not shown in the drawings, a thread cutting mechanism and other components are provided. The thread cutting mechanism is disposed beneath a thread plate (not shown) in the bed portion 20. An upper thread extends from the eye of the needle mounted on the lower portion of each needle bar 36. The thread cutting mechanism is for cutting the upper thread of the needle bar 36 that is in the sewing position, when the needle bar 36 travels from its lowermost position upward.

The needle bar switching mechanism is a mechanism shared by all the multi-needle sewing machines 11 to 13 and operates in the following manner. A needle bar case position detection sensor 52 shown in FIG. 3 detects the position of the needle bar case 35 of the multi-needle sewing machine 12. A stepping motor 63 shown in FIG. 3 is driven to move a connection rod 38 leftward and rightward. Because the connection rod 38 integrally interlocks the three needle bar cases 35, movement of the connection rod 38 moves all of the needle bar cases 35 simultaneously. In other words, the needle bar case position detection sensor 52 detects the position of the needle bar case 35 while the stepping motor 63 moves the connection rod 38 leftward and rightward. The three needle bar cases 35 are simultaneously moved leftward and rightward so that a desired one of the twelve needle bars 36 is selectively switched into the sewing position.

A thread break sensor 57 shown in FIG. 3 is provided along the thread pathway from the thread spools 31 to the sewing needles. The thread break sensor 57 is for detecting a broken thread. When the thread break sensor 57 detects a broken thread, operation of the multi-head embroidery sewing machine M1 is stopped. The thread break sensor 57 can have a conventional configuration including a rotating body around which the thread is wound once along the thread pathway, and a detection mechanism for detecting whether the rotating body is rotating. When the detection mechanism detects that rotation of the rotating body has stopped, it can be assumed that the thread has broken. The detection mechanism can be configured from an encoder disk fixed to the rotating body and an optical sensor disposed adjacent to the encoder disk.

Next, an explanation will be provided for a control system of the multi-head embroidery sewing machine M1. As shown in FIG. 3, a control device 40 for controlling the multi-head embroidery sewing machine M1 includes a CPU 41, a ROM 42, a RAM 43, an input interface 45, an output interface 46, and a transmission interface 47. The CPU 41, the ROM 42, and the RAM 43 configure a microcomputer. The interfaces 45 to 47 are connected to the microcomputer by a bus 44 such as an external data bus. The transmission interface 47 connects the personal computer 2 and the multi-head embroidery sewing machine M2 by way of transmission cables 3, 4, respectively.

The input interface 45 is connected for receiving signals from a principal shaft origin position detection sensor 50, a principal shaft rotational position detection sensor 51, the needle bar case position detection sensor 52, and the various keys provided to the operation panel 32, that is, including the sewing start key 53, the sewing completion key 54, the sewing cancellation key 55, and the numeric pad 56. A variety of control signals are outputted from the output interface 46 including control signals outputted to drive circuits 44 to 48, which respectively are for driving the sewing machine motor 60, the front-rear drive motor 61, the left-right drive motor 62, the stepping motor 63, and the liquid crystal display 33.

The ROM 42 of the control device 40 stores a variety of programs such as a sewing control program for controlling drive of each of the motors 60 to 63 based on embroidery pattern data transmitted from the personal computer 2 and stored in the RAM 43.

The multi-head embroidery sewing machine M1 is directly connected to the personal computer 2 by the transmission cable 3. Therefore, transmission is possible directly between the multi-head embroidery sewing machine M1 and the personal computer 2. Transmission between the other multi-head embroidery sewing machines M2 to M4 and the personal computer 2 is possible via the transmission interface 47 of interposing ones of the multi-head embroidery sewing machines M1 to M3. With this configuration, transmission between the other multi-head embroidery sewing machines M2 to M4 and the personal computer 2 is possible without influencing the microcomputer in the corresponding control device 40.

Here, operations for producing a lot, or group, of an embroidery pattern will be provided while using the multi-head embroidery sewing machine M1 as a representative example. After the sewing start key 53 is turned ON, the stepping motor 63 is driven based on embroidery pattern data stored in the RAM 43 to sew an embroidery pattern in a workpiece cloth set in the embroidery frame 28. The stepping motor 63 is stopped after the embroidery pattern has been sewn once. Then the embroidery frame 28 with the embroidered workpiece cloth is exchanged with a new frame and a new unembroidered workpiece cloth. The sewing start key 53 is again turned ON, and the same embroidery pattern is sewn in the next workpiece cloth. These operations are repeated until the same embroidery pattern has been sewn a predetermined number of times to complete the lot.

Figure 4:
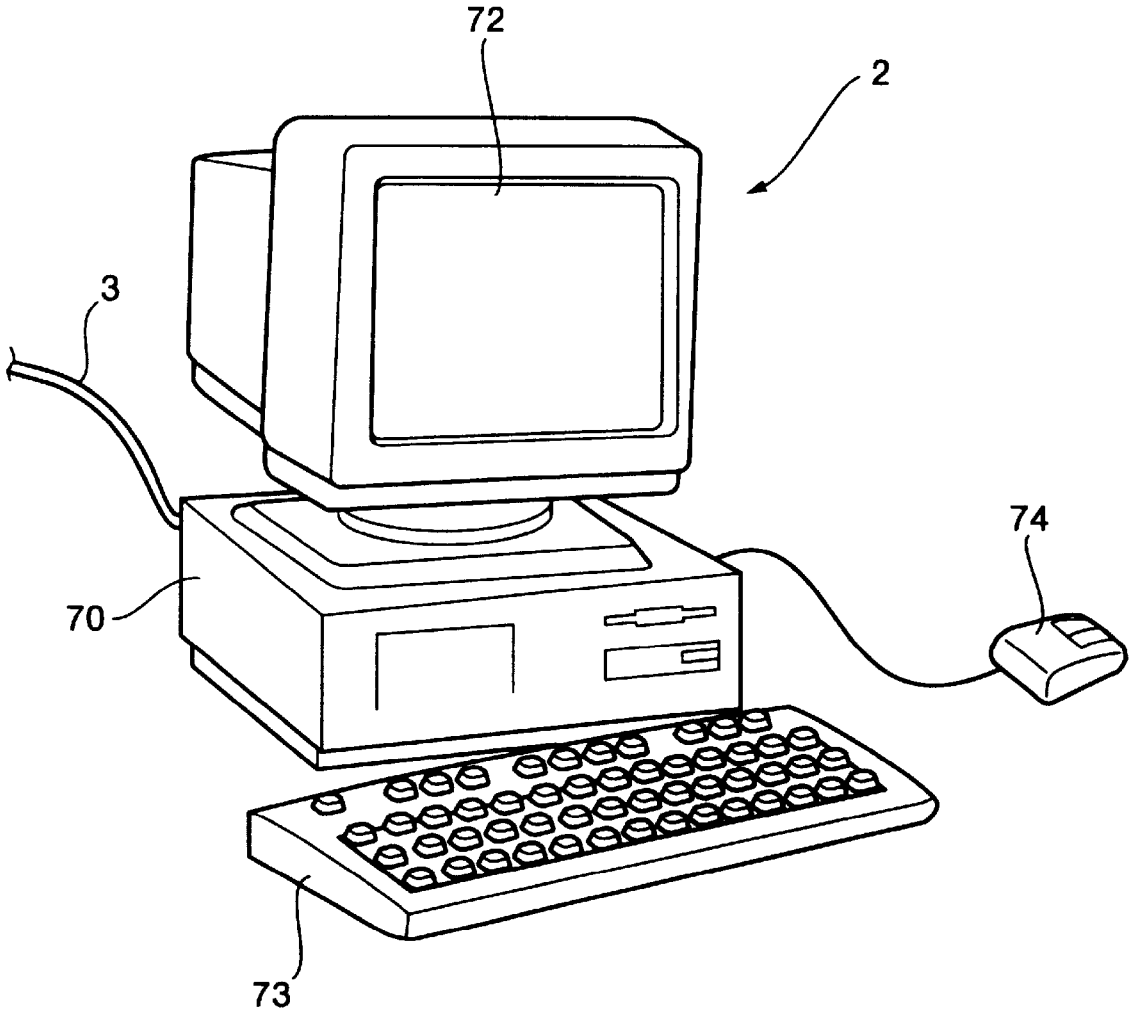
FIG. 4 is perspective view showing a personal computer of the system shown in FIG. 1.
Figure 5:
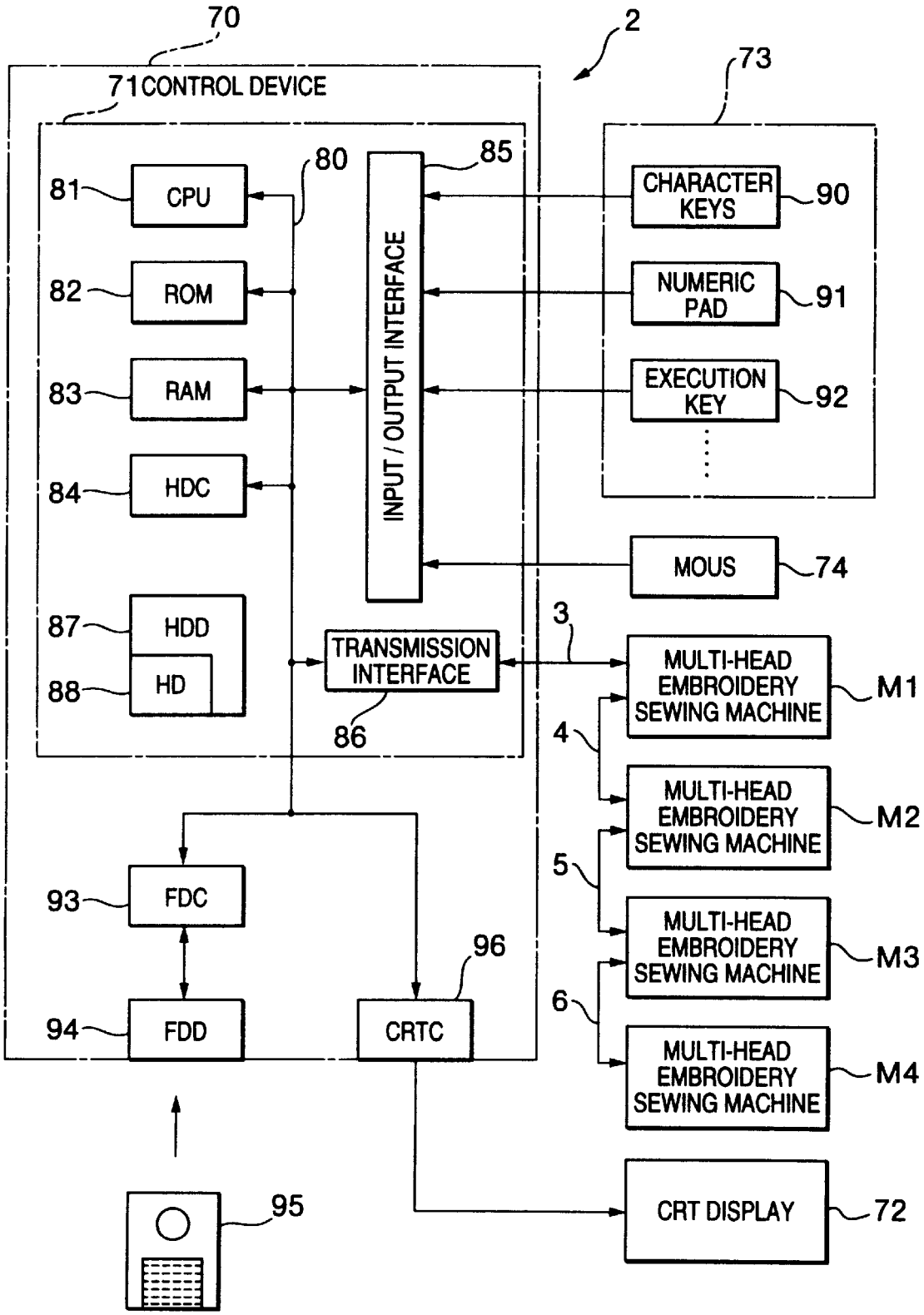
FIG. 5 is a block diagram representing electrical configuration of the personal computer shown in FIG. 4

Next, an explanation will be provided for the personal computer 2 while referring to FIGS. 4 and 5. As shown in FIG. 4, the personal computer 2 includes a personal computer body 70, a CRT display 72, a keyboard 73, and a mouse 74. As shown in FIG. 5, a control device 71 is housed in the personal computer body 70. The keyboard 73 includes a plurality of character keys 90, a numeric pad 90, and an execution key 92. The CRT display 72 is for displaying a variety of screens including a lot time screen 100 shown in FIG. 9 and a file data preparation screen shown in FIG. 11.

The personal computer 2 allots lots to the plurality of the multi-head embroidery sewing machines M1 to M4. It should be noted that, although all the embroidery patterns in any particular lot are the same, different lots can be configured from the same or from different embroidery patterns. Further, "embroidery pattern" as used in the present application refers to an embroidery pattern sewn by an embroidery sewing machine during a single sewing operation in a single workpiece cloth, that is, without changing the embroidery frame that supports the workpiece cloth. In this way, some embroidery patterns are configured from a plurality of different patterns, which are all sewn in the same sewing operation without changing frames.

The personal computer 2 calculates a lot time for each lot. The personal computer 2 calculates each lot time based on embroidery pattern data for sewing the embroidery pattern of the lot, and on repetition number data, which indicates the number of times the embroidery pattern needs to be sewn to complete the subject lot. The personal computer 2 displays, on the CRT display 72, the lot time for the subject lot, along with the lot times for all other lots allotted to the plurality of multi-head embroidery sewing machines M1 to M4.

Next, an explanation for the control system of the personal computer 2 will be described in more detail while referring to FIG. 5. As shown in FIG. 5, the control device 71 of the personal computer 2 includes a CPU 81, a ROM 82, a RAM 83, a hard disk controller (HDC) 84, an input interface 85, a transmission interface 86, and a hard disk drive (HDD) 87. All the components of the control device 71 are connected together by a bus 80 such as a data bus. The hard disk drive 87 includes a hard disk (HD) 88. The hard disk drive 87 is controlled by the hard disk controller 84 to rewrite information stored in the hard disk 88.

The mouse 74 and the components of the keyboard 73, such as the character keys 90, the numeric pad 71, and the execution key 72, are connected to the input/output interface 85. The transmission interface 86 is connected to the transmission interface 47 of the multi-head embroidery sewing machine M1 by the transmission cable 3. Further, the personal computer body 70 houses a floppy disk drive 94, a floppy disk controller 93 for controlling the floppy disk drive 94, and a CRT display controller 96 for outputting display data to the CRT display 72. A floppy disk 95 is detachably mountable in the floppy disk drive 94. The floppy disk controller 93 and the CRT display controller 96 are connected to each other by the bus 80.

The floppy disk 95 stores embroidery pattern data, which includes sewing data and display data, for a plurality of embroidery patterns in correspondence with file name data to be described later.

The ROM 82 of the control device 71 stores a start up program for starting up the personal computer 2 when the power source is turned on in the same way as a general personal computer. The hard disk 88 stores a variety of operation systems, such as MS-DOS or Windows, a variety of driver software, and a transmission control program. The driver software enables the CRT display 72, the keyboard 73, the mouse 74, and the like to be used with the above-described operation systems. The transmission control program enables transmission of a variety of data between the personal computer 2 and the multi-head embroidery sewing machines M1 to M4.

Figure 7:
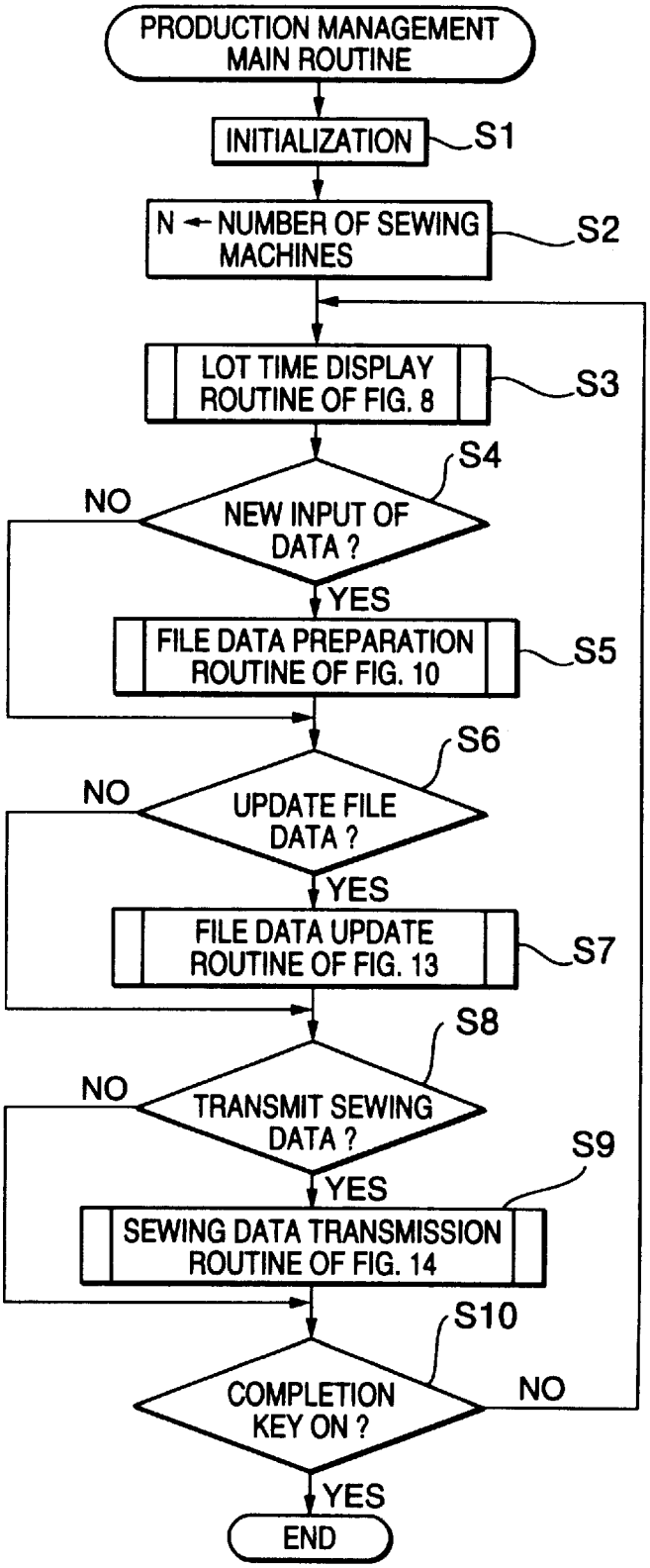
FIG. 7 is a flowchart representing a main routine of a production management routine executed by the personal computer of FIG. 4.

Further, the hard disk 88 stores a production management main routine represented by the flowchart of FIG. 7. The production management program includes a lot time display routine (FIG. 8) for controlling the CRT display 72 to display the lot time of each of a plurality of lots based on various file data; a file data preparation routine (FIG. 10) for preparing file data for each single lot; a file data update routine (FIG. 13) for updating the file data; and a sewing data transmission routine (FIG. 14) for transmitting embroidery pattern data for the embroidery patterns to corresponding ones of the multi-head embroidery sewing machines M1 to M4.

Figure 6:
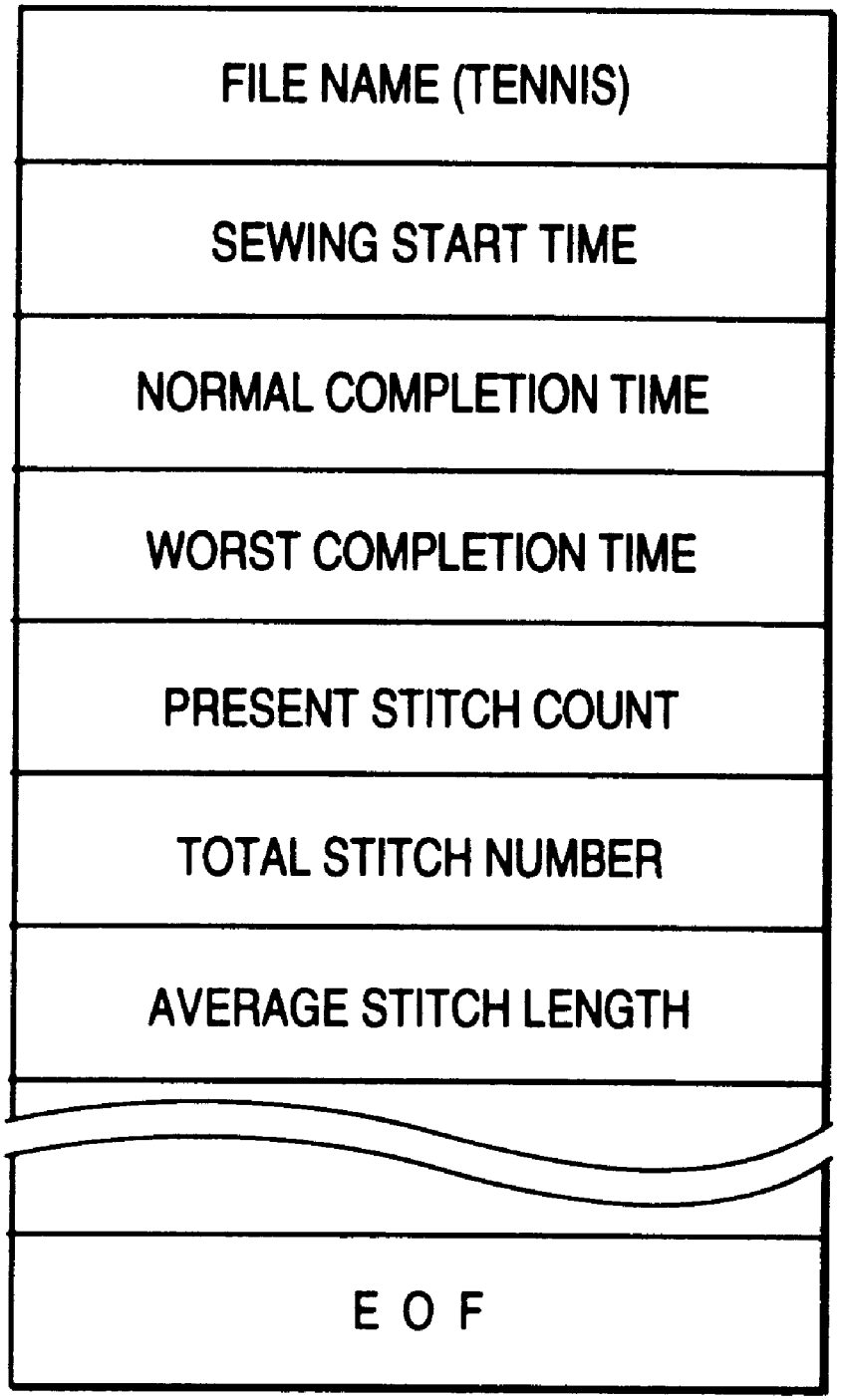
FIG. 6 is a schematic view representing file data stored in a hard disk of the personal computer shown in FIG. 4.

Next, an explanation will be provided for file data while referring to FIG. 6. A plurality of sets of file data, each corresponding to a different lot, are stored in a rewritable condition in the hard disk 88. As shown in FIG. 6, each set of file data includes data indicating the file name, that is, "Tennis" in this example, a sewing start time, a normal completion time, a worst completion time, a present stitch count, a total number of stitches, an average stitch length, and the end of the file.

Next, the main routine of the production management program executed based on the production management program by the control device 71 will be briefly explained while referring to the flowchart in FIG. 7. In this and the following flowcharts, individual steps are indicated by Si, wherein i represents the number of the corresponding step.

Figure 9:
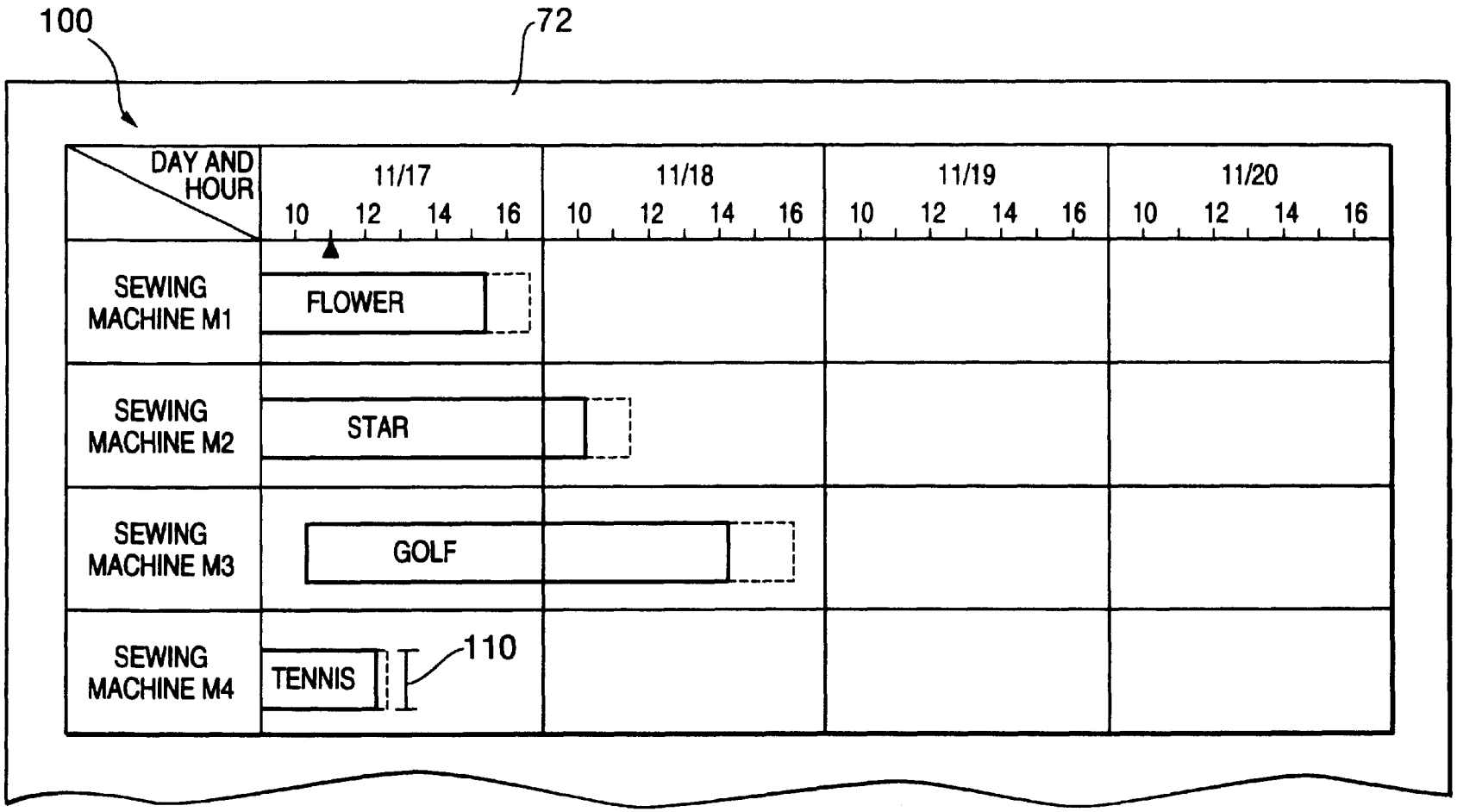
FIG. 9 is a partial plan view showing a production management screen.

The main routine is started when the power source of the personal computer 2 is turned on. First, initial settings are set in S1. Then in S2, a total number of sewing machines N is set to 4 to represent that four multi-head embroidery sewing machines M1 to M4 are connected to the personal computer 2. Next, the lot time display routine is executed in S3. During the lot time display routine, a lot time screen 100 shown in FIG. 9 is displayed on the CRT display 72.

Figure 10:
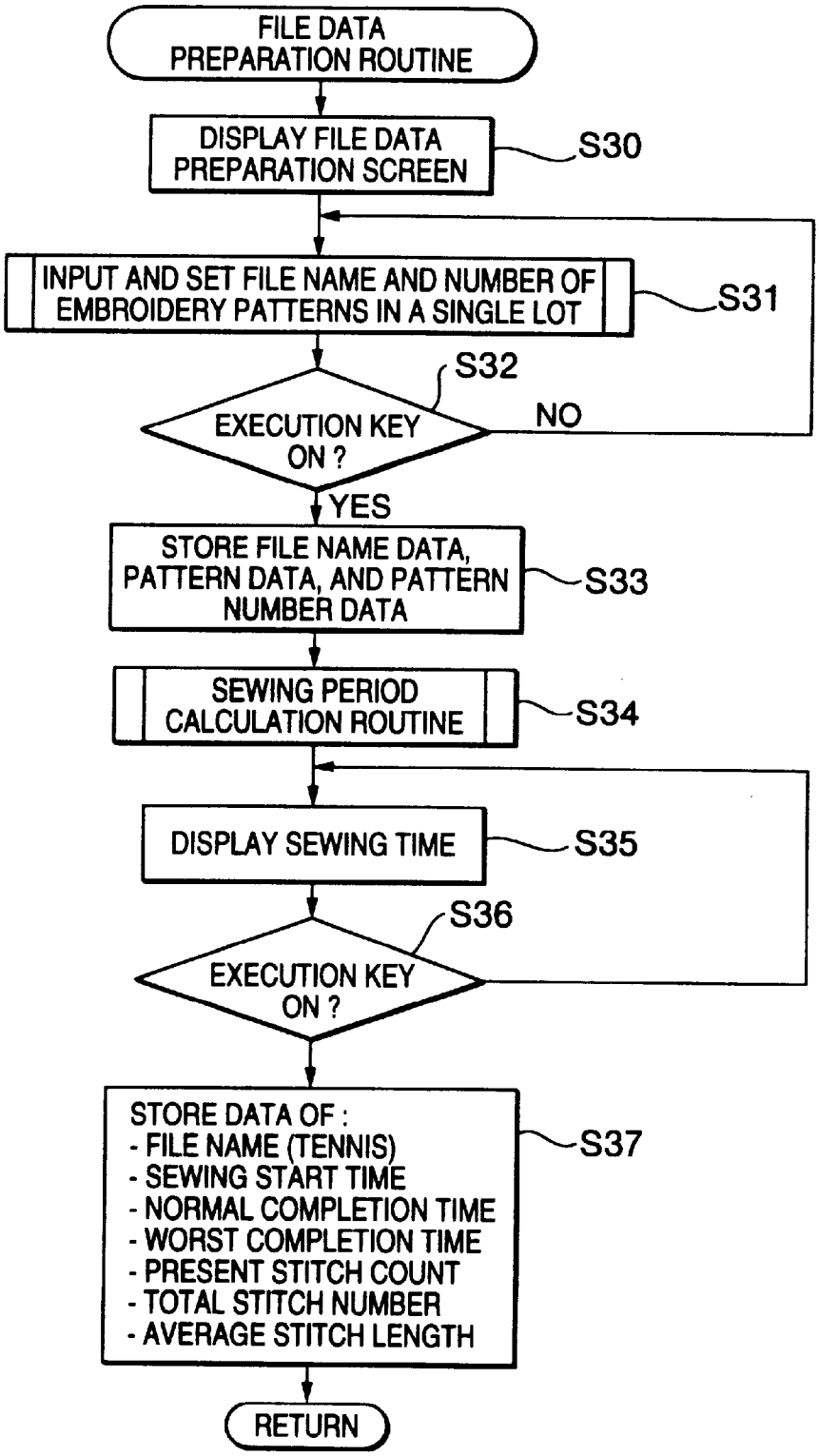
FIG. 10 is a flowchart representing a file data preparation routine.
Figure 11:
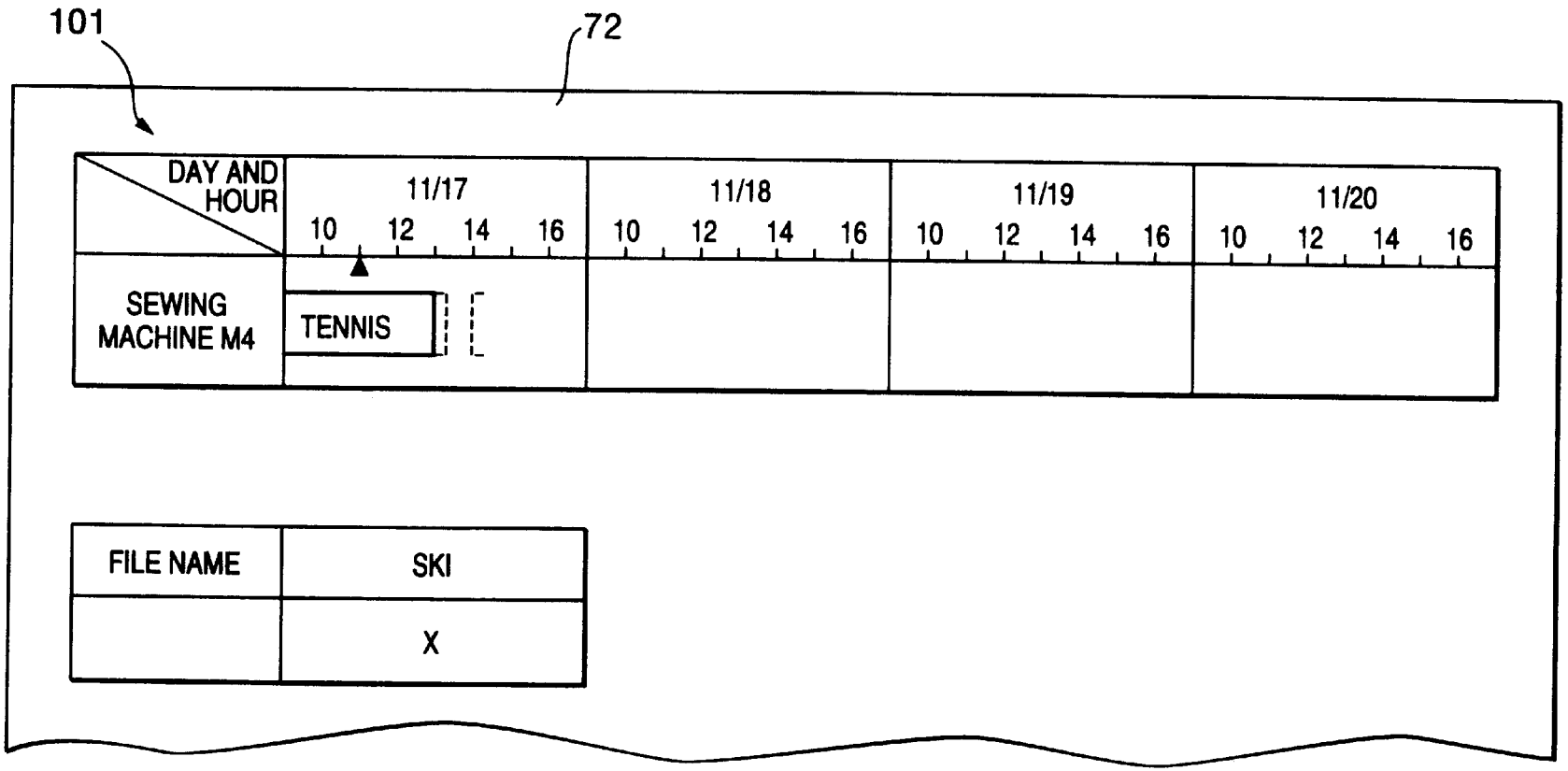
FIG. 11 is a partial plan view showing a file data preparation screen.

When new file data for a new lot is to be inputted (S4:YES), as determined by the execution key 92 being turned ON, then, the file data preparation routine of FIG. 10 is performed in S5. During the file data preparation routine, the file preparation screen 101 shown in FIG. 11 is displayed on the CRT display 72. New file data is prepared according to input of data, for example, through the keyboard 73. Next, it is determined in S6 whether or not the present sets of file data should be updated, for example, based on a predetermined duration of time measured by a clock signal, or based on manual input from the keyboard. When it is determined that file data is to be updated (S6:YES), then the file data update routine is executed in S7.

When sewing data is to be transmitted to one of the multi-head sewing machines M1 to M4 (S8:YES), then the sewing data transmission routine is performed in S9, whereupon embroidery pattern data corresponding to the subject embroidery pattern is transmitted to the corresponding one of the multi-head embroidery sewing machines M1 to M4. The program returns to S3 until a stop key of the keyboard 73 is switched ON (S10:YES), whereupon the program terminates.

Figure 8:
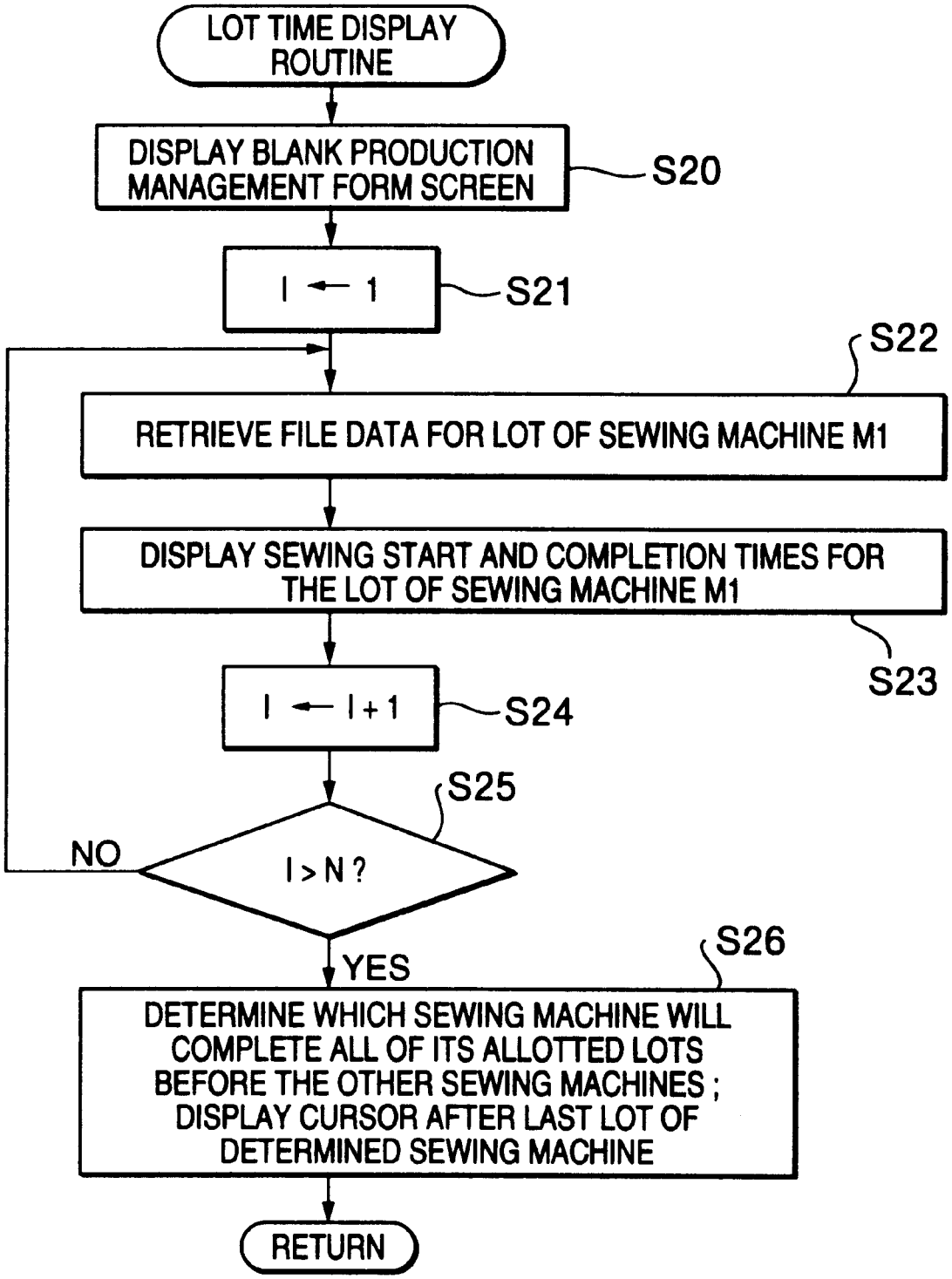
FIG. 8 is a flowchart representing a lot time display routine.

Next, the lot time display routine will be described while referring to the flowchart shown in FIG. 8. In this example, it is assumed that the multi-head embroidery sewing machines M1 to M4 are assigned to sew lots of "Flower," "Star," "Golf," and "Tennis" embroidery patterns, respectively. At the start of the lot time display routine, first a production management form screen is displayed. The production management form screen is the same as the lot time screen 100 of FIG. 9, but without the various bar graphs. That is, the "Flower," "Star," "Golf," and "Tennis" bar graphs are not shown. On the other hand, the production management form screen lists the multi-head embroidery sewing machines M1 to M4 one after the other following the vertical axis and also four consecutive days listed following the horizontal axis in calendar fashion. Each day is displayed divided by hours of the day.

Next, in S21, a present sewing machine value I, which represents the number of the multi-head embroidery sewing machine presently under consideration, is set to an initial value of 1 to indicate that the multi-head embroidery sewing machine M1 is presently under consideration. Then in S22, file data is retrieved for the embroidery pattern of a lot allotted to the multi-head embroidery sewing machine MI, that is, the multi-head embroidery sewing machine M1 in this example. Next, in S23, the lot time for the lot is displayed on the CRT display 72 in bar graph form as shown in FIG. 9. The lot time is displayed with the file name, a sewing start time, a normal completion time, and a worst completion time, based on the file data retrieved in S22. The worst completion time is displayed in dotted line to help the user to distinguish it from the normal completion time.

Next, the present sewing machine value I is incremented by 1 in S24 so that the processes are repeated for the next multi-head embroidery sewing machine M2. It should be noted that, although not shown in the flowchart of FIG. 8, when any of the multi-head embroidery sewing machines M1 to M4 is allotted more than one lot, that is, more than one set of file data, then the processes of S22 and S23 are executed for each lot before the program proceeds to S24 for the next sewing machine. After the present sewing machine value I is incremented in S24, whether or not the present sewing machine value I is greater than the total number of sewing machines N is determined. In this example, the present sewing machine value I has just been incremented to 2, so S22 will result in a negative judgement. As a result, the routine returns to S22, whereupon S22 and S25 are repeated for each of the multi-head embroidery sewing machines M2–M4. After the processes of S22 to S25 have been repeated for all the multi-head embroidery sewing machines M1 to M4, the lot times required for the multi-head embroidery sewing machines M1 to M4 to sew the "Flower," "Star," "Golf," and "Tennis" embroidery patterns, respectively, are displayed on the CRT display 72 as shown in FIG. 9.

Once the processes of S22 to S25 have been repeated for all the multi-head embroidery sewing machines M1 to M4 (S25:YES), then it is determined in S26, which the sewing machine will complete all of its allotted lots first before the other sewing machines. Then, a blinking cursor 110 is displayed on the CRT display 72 behind the last lot of the sewing machine with the overall earliest completion time. In the example shown in FIG. 9, the cursor 110 is displayed behind the sewing completion time of the "Tennis" lot assigned to the multi-head embroidery sewing machine M4, because the "Tennis" lot is predicted to be completed before the lots assigned to the other multi-head embroidery sewing machines M1 to M3. Because the cursor 110 is displayed in correspondence with the multi-head embroidery sewing machine M4, any subsequent new lot inputted in S5 will be allotted to the sewing machine M4. The cursor 110 is displayed at a position separated from the worst completion time by a predetermined preparation time period. This preparation time period reflects the time predicted to be necessary for preparing for a subsequent embroidery operation, and takes changing thread colors, maintenance, and other operations into account. Because the cursor 110 is displayed separated from the sewing completion time by the preparation time period, the user can easily determine the sewing start time of a subsequent lot. The sewing completion time can be easily determined by adding the lot time to the sewing start time. After S26, the program returns to the main routine of FIG. 7.

When the execution key 92 is turned ON during the main routine, then this indicates that a new set of file data is to be inputted. Therefore, S4 results in a positive determination and the file data preparation routine FIG. 10 is performed. As mentioned above, the next lot to be inputted will be allotted to the multi-head embroidery sewing machine M4, because the sewing machine M4 will be freed up first. Alternatively, the user can use predetermined key operations to move the cursor 110 to indicate another sewing machine, thereby allotting the next lot to the other sewing machine. This would enable the user to freely select which one of the plurality of multi-head embroidery sewing machines M1 to M4 will be allotted with the newly entered lot.

Next, an explanation will be provided for the file data preparation routine while referring to the flowchart shown in FIG. 10. At the start of the file data preparation routine, the file data preparation screen shown in FIG. 11 is displayed in S30. The file data preparation screen shown in FIG. 11 displays the line from the lot time screen 100 that corresponds to the multi-head embroidery sewing machine M4, because the sewing machine M4 was specified for allotment of the next lot. Also, the lot time required for sewing the "Tennis" lot allotted to the sewing machine M4 is displayed. Further, a table is displayed so the user can input the file name of the embroidery pattern of the next lot, and also the a repetition number, representing the number of times the embroidery pattern needs to be sewn to complete the new lot.

Next, in S31, the user inputs the file name and the number of times using the numeric pad 91 and the character keys 90 of the keyboard 73. In the example shown in FIG. 11, the user has input the file name "Ski" and the repetition number "x" in S31. When the execution key 92 is turned ON (S32:YES), then in S33, file name data and repetition number data, which corresponds to the file name and repetition number inputted in S31, and also embroidery pattern data, which is read out of the floppy disk 95 based on the file name data, are temporarily stored in the RAM 83.

Next, a lot time calculation routine is performed in S34. During the lot time calculation routine, various time periods and timings are calculated for the new lot. For example, the sewing start time, the normal sewing period required to sew the new lot, the normal completion time, the worst sewing period, and the worst completion time.

To calculate the sewing start time in the lot time calculation routine of S34, the predetermined preparation time period, which was described previously for determining location of the cursor 110, is added to the normal completion time of the lot already allotted to the subject embroidery sewing machine. The predetermined preparation time period is added to the completion time of the "Tennis" lot in this example.

Before calculating the normal sewing period and the worst sewing period, first a sewing machine operation time, which is the duration of time that the sewing machine will actually be operated, is calculated. The sewing machine operation time is calculated based on a total stitch number, an average stitch length, and a drive speed of the subject lot. The total stitch number is the total number of stitches in the lot and is determined by multiplying the number of stitches indicated in the subject embroidery pattern data times the number of times the embroidery pattern is to be sewn in the subject lot. The average stitch length is determined based on the embroidery pattern data. The drive speed is a predetermined value based on the time required for the subject embroidery sewing machine to sew a stitch having a predetermined length.

The normal sewing period is calculated by adding the sewing machine operation time to a frame exchange time and a broken thread repair time. The frame exchange time is the time required to exchange embroidery frames 28, in order to change workpiece cloths, during production of a lot.

The broken thread repair time is the time required to repair broken threads during production of a lot. The worst sewing period is calculated by adding the sewing machine operation time and the frame exchange time to a worst broken thread repair time.

To calculate the normal broken thread repair time, first, a broken thread number is calculated to determine the number of times that thread breaks will probably occur when sewing a single lot of embroidery patterns. The broken thread number is calculated by multiplying a predetermined first broken thread coefficient with the above-described total stitch number. The broken thread number is then multiplied times a broken thread repair unit of time. The broken thread repair unit of time is a preset value and indicates the time estimated to correct each broken thread.

To calculate the worst broken thread repair time, first, a greater possible number of broken threads is calculated by multiplying a larger second broken thread coefficient with the above-described total stitch number. In other words, the second thread break coefficient for the worst broken thread repair time is greater than the first thread break coefficient for the normal broken thread repair time. This greater thread break number is then multiplied times the broken thread repair time.

The normal completion time is calculated by adding the normal sewing period after the sewing start time. The worst completion time is determined by adding the worst sewing period after the sewing start time.

Figure 12:
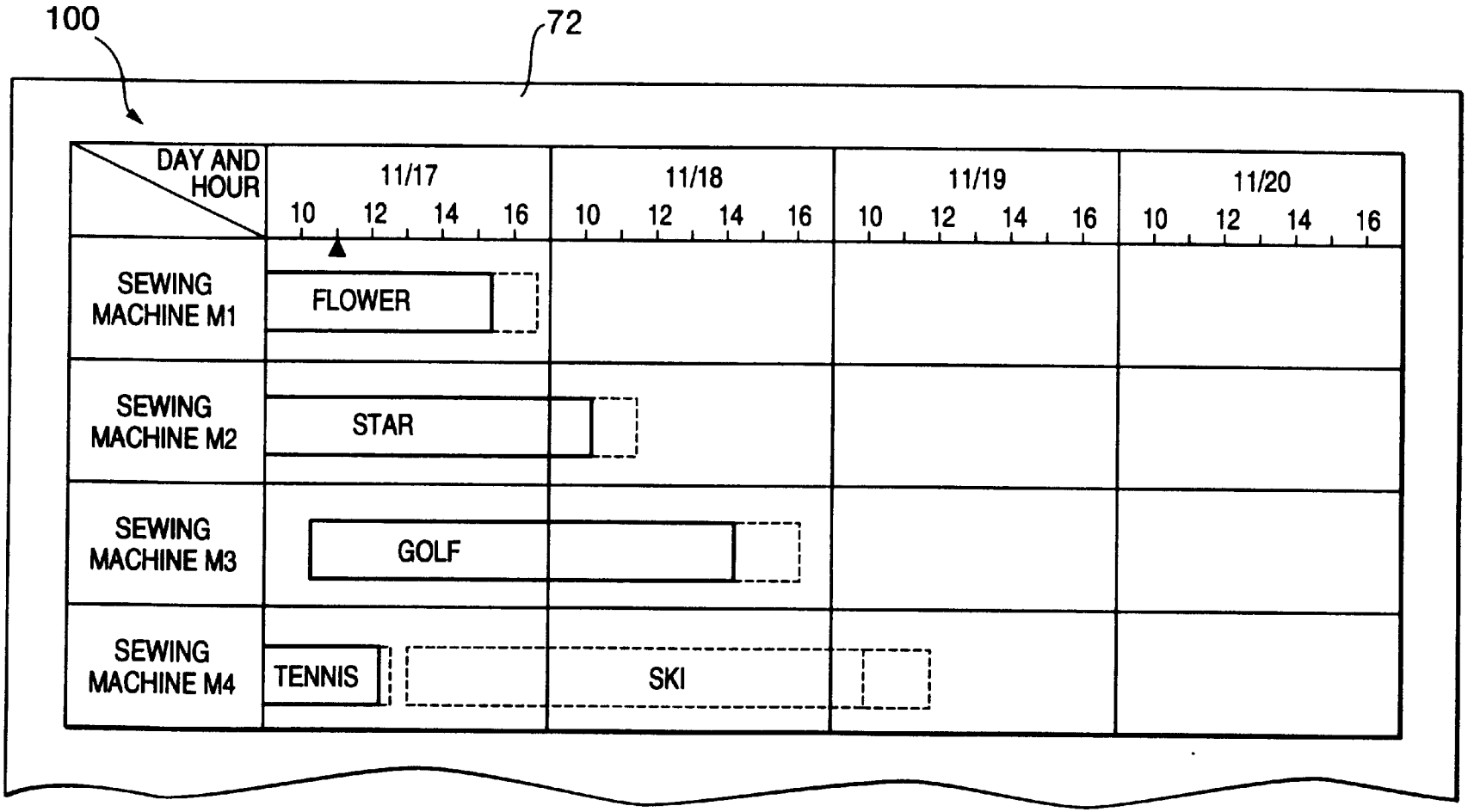
FIG. 12 is a partial plan view showing the production management screen after a new lot has been allotted and its lot times provisionally displayed.

After the embroidery time calculation routine is completed in S34, then the resultant data is used in S35 to display the lot time in the lot time screen 100 on the CRT display 72. As shown in FIG. 12, the lot time is displayed in bar graph form with the "Ski" file name and indicates the sewing start time, the normal completion time, and the worst completion time. At first, the lot time is displayed in broken line. However, when the execution key 92 is turned ON, then in S37 display of the lot time is changed to solid line. Also in S37, the file name, the sewing start time, the normal completion time, the worst completion time, the present stitch count (0), the total stitch number, the average stitch length are stored in a rewritable condition in the hard disk 88. Also, data is stored to indicate that the "Ski" lot has been allotted to the sewing machine M4. Then, the program returns to the main routine.

Figure 13:
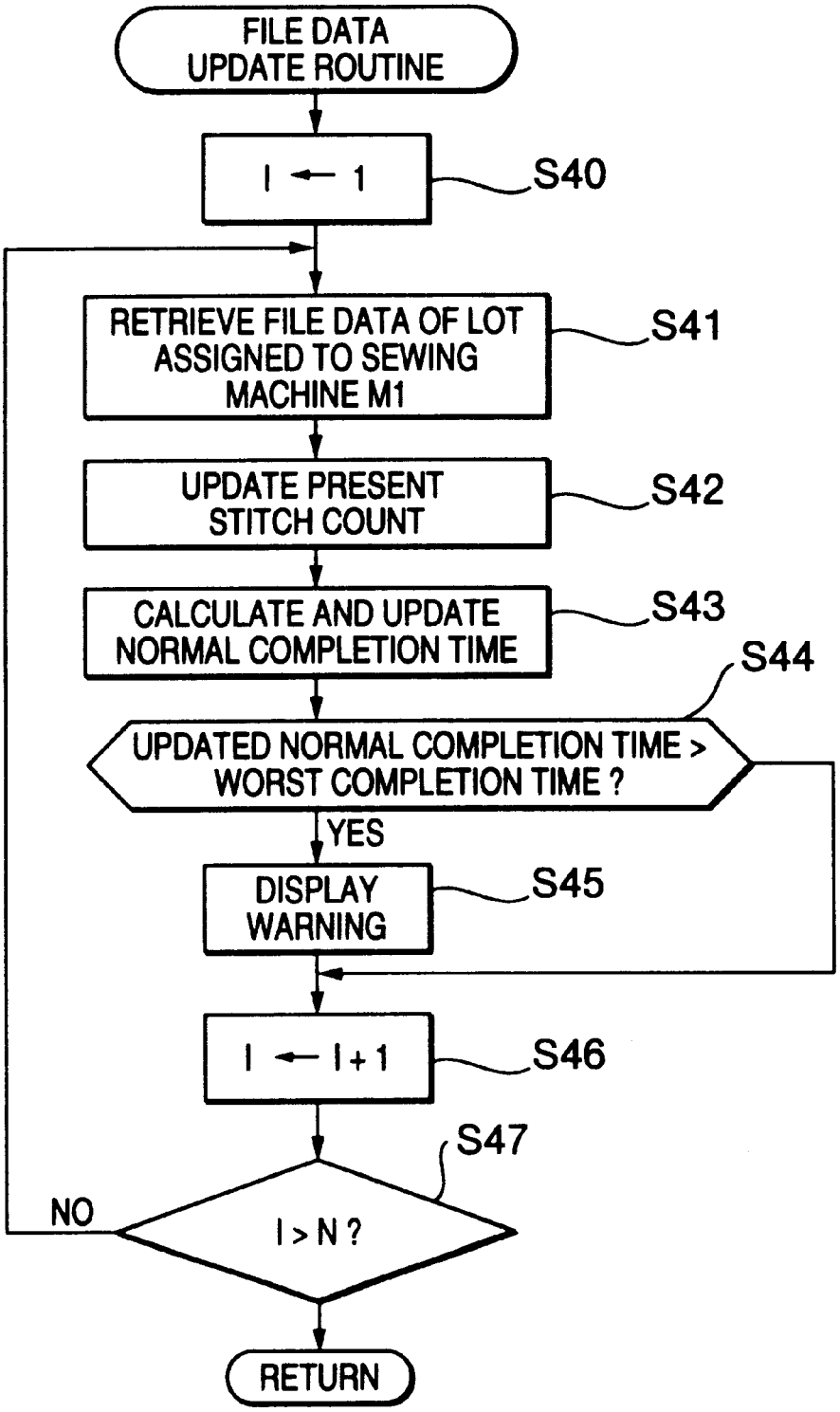
FIG. 13 is a flowchart representing a file data update routine.

Next, the file data update routine of FIG. 13 will be described. The file data update routine updates the normal completion time for the lot presently being sewn by each sewing machine, and also the sewing start time, the normal completion time, and the worst completion time for each lot planned to be sewn by each sewing machine after the presently sewn lot.

The file data update routine will be described while referring to the flowchart in FIG. 13. When the file data update routine is executed, first, the present sewing machine value I is reset to 1 in S40. Next in S41, the file data for the lot presently being sewn by the multi-head embroidery sewing machine MI is retrieved. Then in S42, the present stitch count of the file data is updated according to data supplied from the multi-head embroidery sewing machine MI about the number of stitches that have been sewn for the present lot up to now. Next in S43, the normal completion time is calculated and updated based on the present stitch count.

To calculate the normal completion time, first, the present number of stitches is subtracted from the total number of stitches to calculate the remaining number of stitches in the lot. The remaining number of patterns is calculated based on the remaining number of stitches. Next, the remaining sewing machine operation time and the remaining normal broken thread repair time are calculated based on the remaining number of stitches and the remaining frame exchange time is calculated based on the remaining number of embroidery patterns. The normal completion time is calculated by totaling the remaining sewing machine operation time, the remaining normal broken thread repair time, and the remaining frame exchange time.

After the normal completion time has been updated in S43, then it is judged in S44 whether the normal completion time is greater than the worst completion time. If so (S44:YES), this means that sewing operations are late, so in S45 a predetermined warning screen is displayed on the CRT display 72. On the other hand, if the normal completion time is smaller than the worst completion time (S44:NO), this means that sewing operations are on schedule. After a negative judgement in S44 or after the processes of S45, the present sewing machine value I is incremented by 1 in S46. In S47, it is determined whether or not the present sewing machine value I is greater than the total number of sewing machines N. If so (S47:YES), then the program returns to S8 of the main routine. When the present sewing machine value I is less than the total number of sewing machines N (S47:NO), then the program returns to S41 of this routine.

Figure 14:
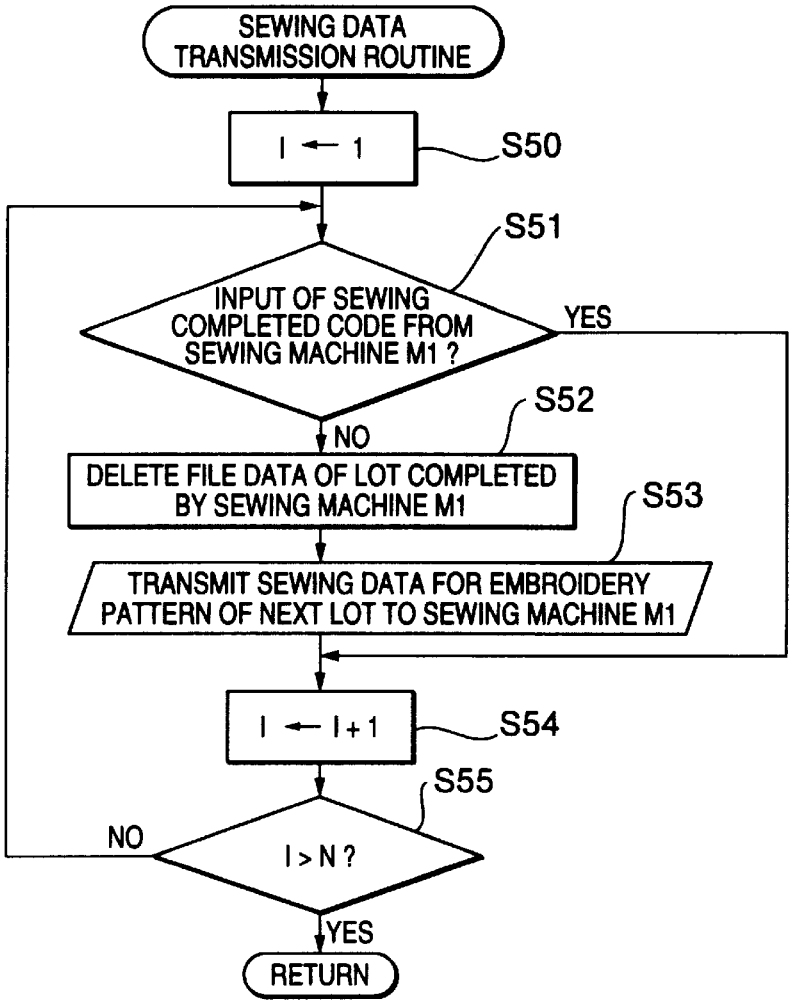
FIG. 14 is a flowchart representing a sewing data transmission routine.

Next, the sewing data transmission routine will be described while referring to the flowchart in FIG. 14. When the sewing data transmission routine is started, then the present sewing machine value I is reset to 1 in S50. Next, when a sewing completion code is inputted from the multi-head embroidery sewing machine MI (S50:YES), then in S51, the file for the lot that has just been sewn by the multi-head embroidery sewing machine MI is deleted in S52. Then, the embroidery pattern data for the embroidery pattern of the next lot is transmitted to the multi-head embroidery sewing machine M1 in S53. After the embroidery pattern data is transmitted to the multi-head embroidery sewing machine M1 in S53 or no sewing code is inputted from the multi-head embroidery sewing machine M1 (S51:NO), then the present sewing machine value I is incremented by 1 in S54. In S55, it is determined whether the present sewing machine value I is greater than the total number of sewing machines N. If so (S55:YES), then the program returns to the main routine. If the present sewing machine value I is not greater than the total number of sewing machines N (S55:NO), then the program returns to S51 of this routine.

With this configuration, the lot time required for sewing a single lot of an embroidery pattern can be easily and accurately determined, because the lot time is calculated based on data indicating the embroidery pattern of the lot and on data indicating the number of times the embroidery pattern is to be sewn in the lot.

Also, lot times of all lots allotted to all the embroidery sewing machines are displayed on the CRT display 72. Since all lots that are being sewn and that are scheduled to be sewn are displayed, the manager can easily plan a sewing schedule for sewing operations to be performed by the plurality of embroidery sewing machines. Therefore, production management can be accurately performed.

Further, the lot times for each lot is displayed in correspondence with the embroidery sewing machine sewing the lot. This allows the manager to easily determine which sewing machine is sewing which lot, and which sewing machine will be finished first.

Further, each new lot is allotted to the sewing machine that is scheduled to complete its presently allotted lot or lots sooner than the other embroidery sewing machines. Therefore, each lot is automatically allotted to the most appropriate embroidery sewing machine so that work is distributed evenly to all of the embroidery sewing machines.

Because the lot time, the sewing start time, and the sewing completion time for both the normal completion time and the worst completion time can be calculated, the lot time, the sewing start time, and the sewing completion time for the plurality of lots allotted to the plurality of embroidery sewing machines can be displayed on the CRT display 72. This enables the manager to easily grasp the lot times of all lots.

The lot time is calculated by adding the sewing machine operation time, the frame exchange time, and the broken thread repair time, all based on the total number of stitches in the lot. Therefore, the lot time can be determined with extreme accuracy, because the total time reflects the operation time required for exchanging embroidery frames and the time required for repairing broken threads. Also, even though the time required for exchanging embroidery frames and for repairing broken threads varies depending on the total number of patterns in the lot and on the total number of stitches in the lot, these variations are taken into account with the configuration of the present invention so that production management can be even more accurately planned.

The worst completion time of any lot time can be updated to take unforeseen troubles at the sewing machines into account. First the number of stitches already sewn for the subject lot is counted, and then the number of stitches remaining from the total number of stitches is used to update the worst completion time. The user can therefore accurately determine the sewing completion time even if sewing operations for a presently sewn lot are not going according to schedule because of some sort of trouble at the sewing machines. This enables the manager to easily replan his or her sewing schedule for the embroidery sewing machines whenever trouble delays the completion times. Because sewing periods and times are automatically recalculated and again displayed on the display, the manager need not again input the various periods and timings described above.

Also, a predetermined warning screen is displayed on the CRT display 72 when the normal completion time that was updated using the completion time update routine indicates that the subject lot will not be completed until after the worst completion time initially calculated for the same lot. As a result, the manager can easily grasp the sewing operation condition by viewing the CRT display 72.

The lot time, including the above-described periods and timings, for each of the plurality of lots is displayed with the corresponding embroidery sewing lot in bar graph form on the CRT display 72. Therefore, the manager can grasp the lot time for each of the plurality of lots allotted to the plurality of embroidery sewing machines with extreme ease.

Figure 15:
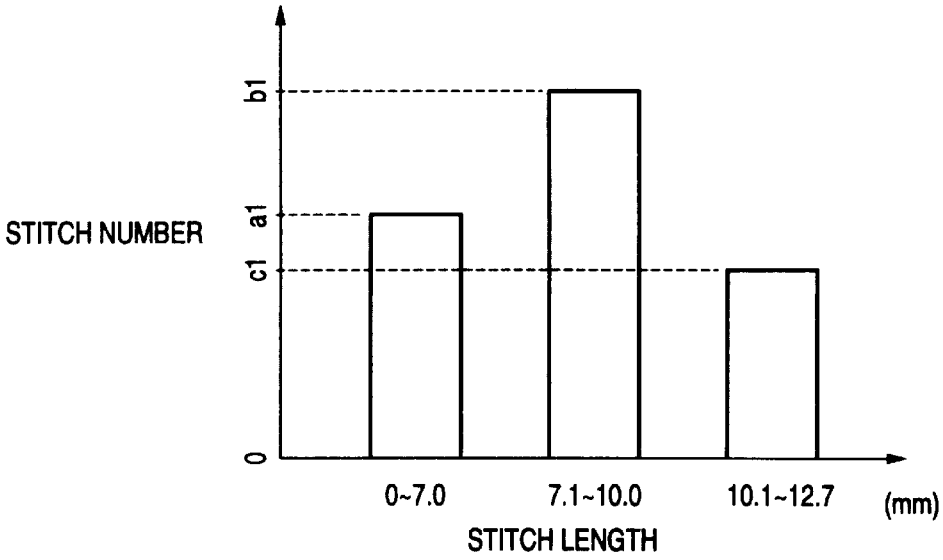
FIG. 15 is a graphical representation of stitch distribution data according to a modification of the embodiment.

Next, modifications of the above-described embodiment will be described. File data can further include stitch number distribution data. Stitch number distribution data indicates how many stitches of the subject embroidery pattern fall into which ones of three different stitch length groups. In the example shown in FIG. 15, stitches are divided by stitch length into three groups: 0 to 7.0 mm, 7.1 to 10.0 mm, 10.1 to 12.7 mm. The number of stitches in each group is a1, b1, and c1 respectively.

The stitch number distribution data is determined by multiplying unit stitch distribution data of embroidery pattern data times the number of embroidery patterns in a single lot. It should be noted that the unit stitch distribution data is desirably appended to embroidery pattern data for the embroidery patterns. However, the unit stitch distribution data can be determined based on the embroidery pattern data.

Figures 16, 17:
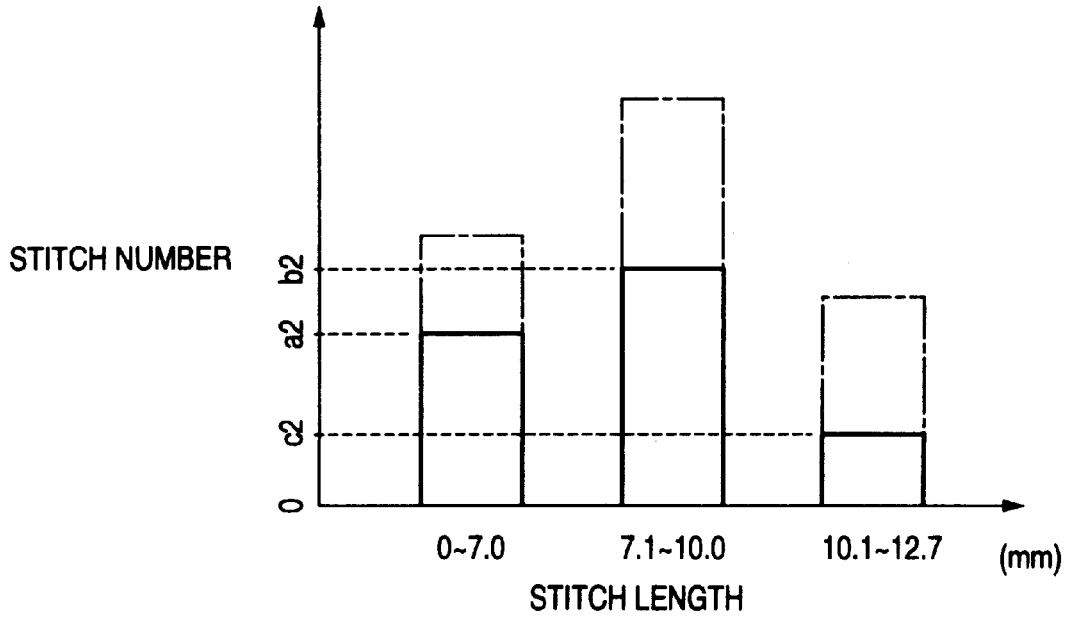
FIG. 16 is a schematic view showing a sewing speed map.
FIG. 17 is a graphical representation of stitch distribution data according to the modification.

The sewing speed of the multi-head embroidery sewing machines M1 to M4 is determined based on the sewing speed map shown in FIG. 16. The sewing speed map is divided into three ranges 1, 2, and 3 in the vertical direction and three stitch lengths in the horizontal direction. Sewing speeds are provided for each stitch length of each range in stitches per minute (spm). In the example shown in FIG. 16, stitch lengths are grouped into three groups of 0 to 7.0 mm, 7.1 to 10.0 mm, and 10.1 to 12.7 mm. The ranges represent speed at which the frame, the needle bars, and other sewing mechanisms of the sewing machines are driven, and can be selected by the manager during the file data preparation routine, for example.

The sewing machine operation time of the lot time can be calculated based on the sewing speed map and the stitch number distribution data. For example, when range 1 is selected, sewing machine operation time is the sum of (a1/e), (b1/f), and (c1/g).

As shown in FIG. 17, stitch number distribution data for the number of stitches presently remaining can be determined at any time by dividing the number of stitches that have already been sewn by stitch length (i.e., 0 to 7.0 mm, 7.1 to 10.0 mm, 10.1 to 12.7 mm). The sewing machine operation time of what is left of the lot time can be determined based on the stitch number distribution data and the normal completion time can be updated accordingly.

In the example shown in FIG. 17, the stitch number distribution data of the lot presently being sewn indicates that a2 stitches remain for the stitch length 0 to 7.0 mm, a3 stitches remain for the stitch length 7.1 to 10.0 mm, and c2 stitches remain for the stitch length 10.1 to 12.7 mm. In this case, the remaining sewing machine operation time is the sum of (a2/e), (b2/f), and (c2/g). Because the sewing machine operation time can be more accurately determined, the normal completion time, and the worst completion time can also be more accurately determined.

Figure 18:
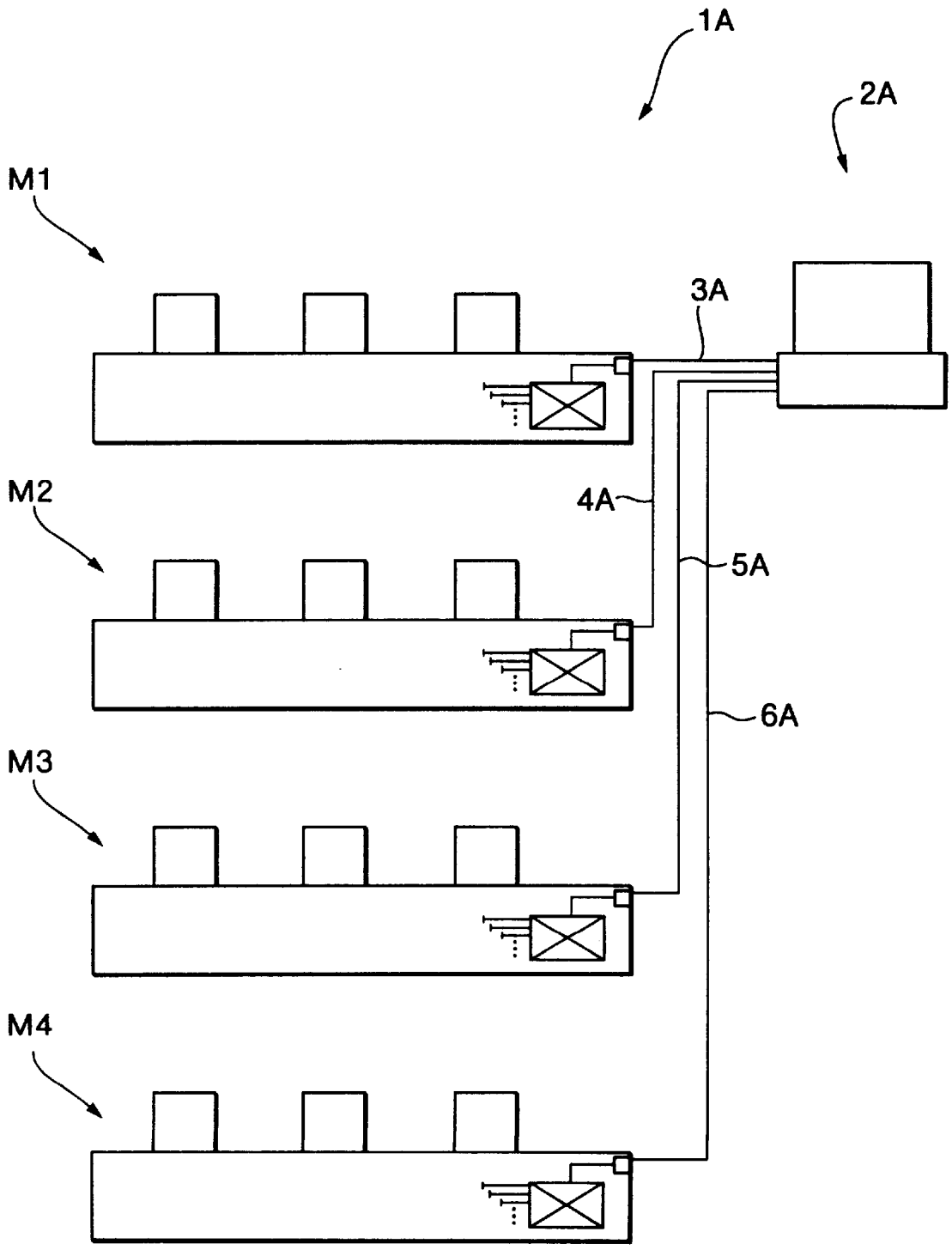
FIG. 18 is a schematic representation of a production system according to another embodiment of the present invention.

Next, an explanation will be provided for a second embodiment of the present invention while referring to FIG. 18. As shown in FIG. 18, a production system 1A has substantially the same configuration as the production system 1 of the first embodiment. However, according to the second embodiment, a personal computer 2A is connected to the multi-head embroidery sewing machines M1 to M4 in parallel by transmission cables 3A to 6A. In other words, the personal computer 2A and the four multi-head embroidery sewing machines M1 to M4 are connected for transmitting data using a star configuration.

Figure 19:
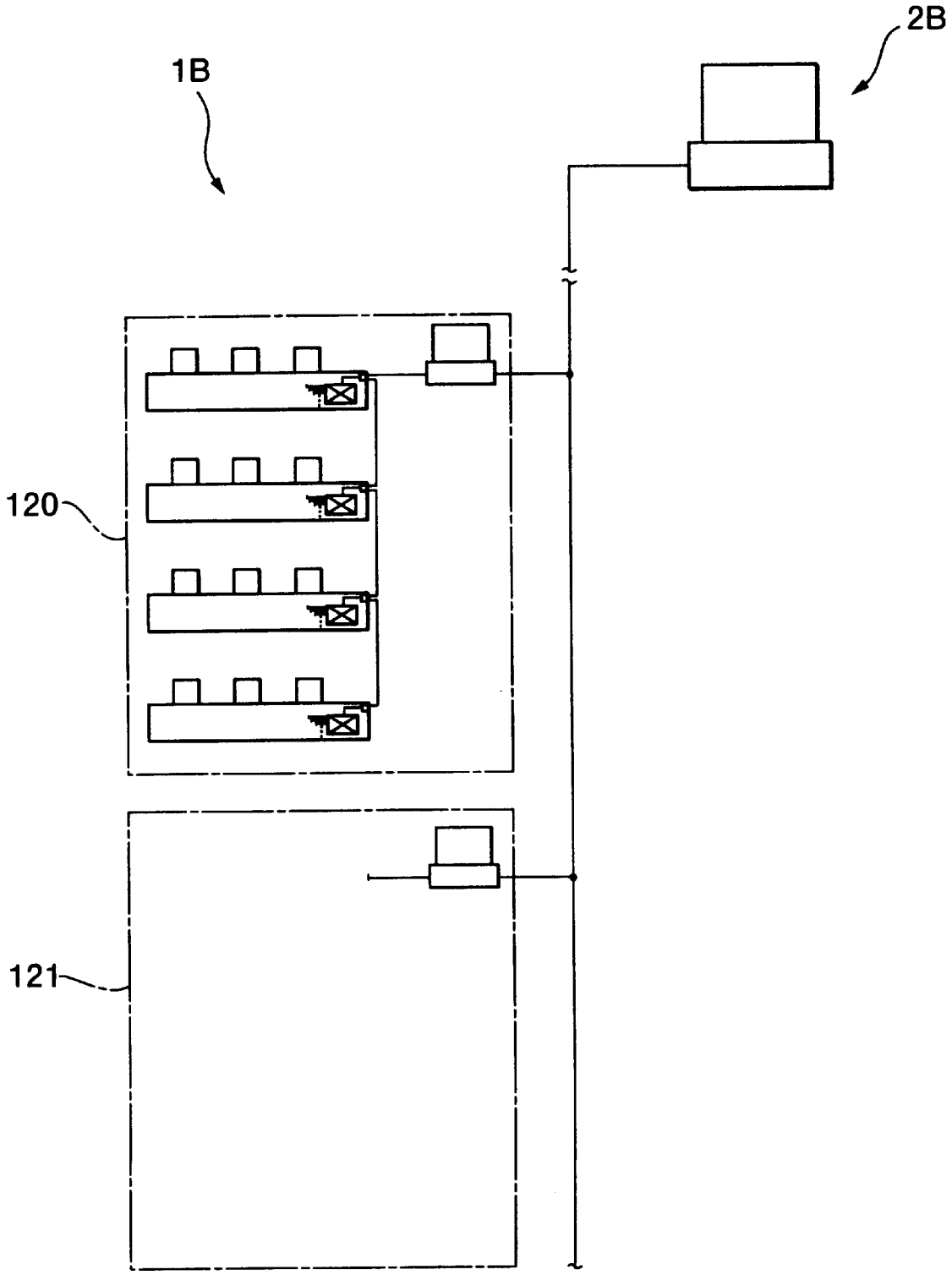
FIG. 19 is a schematic representation of a production system according to still another embodiment of the present invention.

Next, a third embodiment of the present invention will be described while referring to FIG. 19. FIG. 19 shows a production system 1B according to the third embodiment. According to the third embodiment, a host computer 2B is connected to a plurality of production management blocks 120, 121, and so on. Each production management block 120, 121, and the like are the same as the production system 1 of the first embodiment. Overall production management can be easily performed by a great number of embroidery sewing machines.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A system for managing production of embroidery patterns embroidered by a plurality of sewing machines connected to the system, the system comprising:

a display unit;

an allotment unit that allots lots of embroidery patterns to the plurality of sewing machines;

a lot time calculator that calculates a set of lot time data indicating estimated time required to sew an embroidery pattern in a plurality of times to produce a single lot of the embroidery pattern, the lot time calculator calculating the set of lot time data based on embroidery pattern data of the embroidery pattern and on repetition data indicating the plurality of times the embroidery pattern must be sewn to produce the single lot, the lot time calculator calculating a plurality of sets of lot time data, each set corresponding to one of the lots allotted to the sewing machines by the allotment unit; and a display control unit that, based on the sets of lot time data, controls the display unit to display lot times of all lots allotted to the sewing machines by the allotment unit.

2. A system as claimed in claim 1, wherein the allotment unit determines an earliest sewing machine of the plurality of sewing machines, which has an earliest completion time predicted for completing all of its allotted lots, and allots a new lot to the earliest sewing machine.

3. A system as claimed in claim 2, wherein the lot time calculator calculates a set of lot time data for each lot based on total number of stitches in each lot, the lot time calculator calculating the total number of stitches in each lot based on corresponding embroidery pattern data and repetition number data.

4. A system as claimed in claim 2, wherein the lot time calculator calculates a sewing start time and a sewing completion time of each lot time.

5. A system as claimed in claim 4, wherein the lot time calculator determines a sewing start time for the new lot by adding a predetermined preparation time after a sewing completion time of a lot of the earliest sewing machine directly before the new lot.

6. A system as claimed in claim 1, wherein the lot time calculator determines a sewing start time for a new lot newly allotted to an earliest sewing machine, by adding a predetermined preparation time after a sewing completion time of a directly prior lot of the earliest sewing machine.

7. A system as claimed in claim 1, wherein the lot time calculator calculates a set of lot time data for each lot based on total number of stitches in each lot, the lot time calculator calculating the total number of stitches in each lot based on corresponding embroidery pattern data and repetition number data.

8. A system as claimed in claim 7, wherein the lot time calculator calculates, for each lot and based on the total number of stitches in each lot, a sewing machine operation time that the corresponding sewing machine is predicted to actually operate during production of each lot, an embroidery frame exchange time required to exchange an embroidery frame for supporting a workpiece cloth, and a thread repair time required to repair thread breaks, and calculates the lot time for each lot by adding corresponding sewing machine operation time, embroidery frame exchange time, and thread repair time.

9. A system as claimed in claim 8, wherein the lot time calculator calculates a sewing start time and a sewing completion time of each lot time.

10. A system as claimed in claim 9, further comprising a completion time updating unit that updates sewing completion time of each lot time using remaining stitch numbers of corresponding total stitch numbers.

11. A system as claimed in claim 10, wherein the display control unit controls the display unit to display a predetermined warning screen when a sewing completion time updated for one of the lots by the completion time updating unit is later than a sewing completion time previously calculated for the same lot.

12. A system as claimed in claim 1, wherein the lot time calculator calculates a normal completion time and a worse completion time of each lot.

13. A system as claimed in claim 1, wherein the display control unit displays the lot times for the lots on the screen in graphical form in correspondence with the plurality of embroidery sewing machines.

14. A system as claimed in claim 13, wherein the display control unit displays the lot times in bar graph form.

15. A system as claimed in claim 1, wherein the display control unit controls the display unit to display the lot times and sewing machines in correspondence by lot.

16. A system for managing production of embroidery patterns embroidered by a plurality of sewing machines connected to the system, the system comprising:

a display unit;

a lot time calculator that calculates a set of lot time data indicating estimated time required to sew an embroidery pattern in a plurality of times to produce a single lot of the embroidery pattern;

an allotment unit that allots the single lot to one of the plurality of sewing machines; and a display control unit that controls the display unit to display the lot time of the lot allotted to the one of the plurality of sewing machines.

17. A memory medium storing a program for managing production of embroidery patterns embroidered by a plurality of sewing machines, the program comprising:

an allotment program that allots lots of embroidery patterns to the plurality of sewing machines;

a lot time calculation program that calculates a set of lot time data indicating estimated time required to sew an embroidery pattern in a plurality of times to produce a single lot of the embroidery pattern, the lot time calculation program calculating the set of lot time data based on embroidery pattern data of the embroidery pattern and on repetition data indicating the plurality of times the embroidery pattern must be sewn to produce the single lot, the lot time calculation program calculating a plurality of sets of lot time data, each set corresponding to one of the lots allotted to the sewing machines during the allotment program; and a display control program that, based on the sets of lot time data, controls a display unit to display lot times of all lots allotted to the sewing machines during the allotment program.

* * * * *